US006223629B1

(12) United States Patent
Bangert

(10) Patent No.: US 6,223,629 B1
(45) Date of Patent: May 1, 2001

(54) CLOSED-HEAD POWER TONGS

(76) Inventor: Daniel S. Bangert, 156 Beau Coteau Pkwy., Broussard, LA (US) 70518

( * ) Notice: Subject to any disclaimer, the term of this patent is extended or adjusted under 35 U.S.C. 154(b) by 0 days.

(21) Appl. No.: 09/349,292

(22) Filed: Jul. 8, 1999

(51) Int. Cl.[7] ..... B25B 17/00
(52) U.S. Cl. ..... 81/57.15; 81/57.33
(58) Field of Search ..... 81/57.15, 57.16, 81/57.18, 57.19, 57.2, 57.33, 57.34

(56) References Cited

U.S. PATENT DOCUMENTS

| | | | | |
|---|---|---|---|---|
| 1,811,666 | | 6/1931 | Foster . | |
| 4,372,026 | | 2/1983 | Mosing . | |
| 4,404,876 | * | 9/1983 | Eckel | 81/57.18 |
| 4,572,036 | | 2/1986 | Renfro . | |
| 4,649,777 | * | 3/1987 | Buck | 81/57.19 |
| 4,836,064 | * | 6/1989 | Slator | 81/57.18 |
| 4,869,137 | | 9/1989 | Slator . | |
| 4,979,356 | * | 12/1990 | Vatne | 81/57.16 |
| 5,044,232 | * | 9/1991 | Schulze-Beckinghausen | 81/57.18 |
| 5,271,298 | | 12/1993 | Gazel-Anthoine . | |
| 5,291,808 | * | 3/1994 | Buck | 81/57.18 |
| 5,819,605 | * | 10/1998 | Buck et al. | 81/57.33 |
| 5,845,549 | * | 12/1998 | Bouligny | 81/57.33 |

* cited by examiner

*Primary Examiner*—Timothy V. Eley
*Assistant Examiner*—Dung Van Nguyen
(74) *Attorney, Agent, or Firm*—Roy, Kiesel & Tucker

(57) ABSTRACT

Closed head power tongs used to make up and break threaded pipe joints are disclosed herein. The closed head power tongs have removable mating inserts that allow the gripping aperture of the power tongs to be increased so that objects larger than the gripping diameter of the tongs can be raised or lowered through the center aperture of the power tong without removing the tongs from alignment with the drill string.

23 Claims, 15 Drawing Sheets

CLOSED-HEAD POWER TONGS

BACKGROUND OF INVENTION

The present invention relates to power tongs typically used in the oil and gas industry to make up and break apart threaded joints on pipe, casing, and similar tubular members.

Power tongs have been used for many years and are generally employed in the oil and gas industry to grip and rotate tubular members, such as tubular. The tubular members are gripped with high compressive forces while applying a high degree of torque to break apart or tighten threaded tubular member connections. In most cases, power tong designs employ a cam mechanism for converting a portion of the torque into a gripping (compressive) force normal to the tubular member. This conversion is often accomplished using a power-driven ring gear having an interior cam surface. As the ring gear rotates, cam follower (roller) on a jaw member rides upon the cam surface, causing the follower (and thus the jaw member) to move into contact with the tubular member. U.S. Pat. No. 4,404,876 discloses such an arrangement.

Most current power tong designs include a ring gear cam with an open slot or throat ("open-throat power tongs"), through which the tubular member passes to position the jaw members around the tubular member. However, some tong designs employ a ring gear cam that has no open throat and is thus a solid circular member. This solid circular ring gear design is generally referred to as a closed-head power tong.

When the drilling environment allows the use of a derrick or similar overhead structure from which a power tong may be suspended, an openthroat power tong is often a more efficient tool. Open-throat power tongs easily disengage and/or retract from the tubular member when the operator desires to raise, lower, or otherwise manipulate the tubular member.

On the other hand, a closed-head power tong is more difficult to retract from the tubular member because it has a closed throat and must pass over the end of a tubular member. However, there are common drilling environments where there is no structure from which an open-throat power tong may be suspended and insufficient workspace to engage and retract open-throat power tongs. In such environments, a closed-head power tong may be the only practical alternative. Closed-head power tongs are highly useful during operations where snubbing units are employed. Typically, closed-head power tongs are positioned over the drill string with the individual tubular members forming the drill string extending through a center aperture in the closed-head power tong. A tubular member is moved vertically through the center aperture until the threaded joints for connecting adjacent tubular members are in position to be made up (screwed together) or broken out (unscrewed).

To increase efficiency, as many successive tubular member connections as possible are made-up or broken out without interruption, i.e. having to move the center aperture of the tong out of alignment with the drill string. However, the drill string may include a down hole tool or other device that has a diameter greater than the diameter of the center aperture of the closed-head power tong. In these situations, the prior art closed-head power tongs typically require that the drill string be broken and any tubular positioned in the center aperture at that point be removed therefrom. The closed-head power tongs are then removed from alignment with the drill string, and the oversized tool is removed from the drill string or re-positioned vertically along the drill string above or below the power tong such that it is not required to pass through the power tong. The closed-head power tong can then be re-aligned with the drill string. To re-establish the connection of the drill string through the center aperture, the unconnected tubular joint must be positioned above or below the center aperture to reconnect to a continuous length of drill string.

What is need in the art is a closed-head power tong design which allows the center aperture to be readily increased in diameter without the necessity of removing the drill string from the center aperture. The closed-head power tong design should provide for center aperture enlargement with a minimum lost time and with such simplicity that unskilled workers could perform the task.

OBJECTS AND SUMMARY OF THE INVENTION

With the aforementioned considerations in mind, it is therefore an object of this invention to provide a power tong assembly used in connection with a conventional snubbing unit.

It is a further object of the present invention to provide a closed head power tong that is adapted to increase the gripping aperture therein to allow passage of objects having a diameter larger than the normal gripping aperture.

It is a further object of the present invention to provide a closed head power tong that may be quickly and efficiently operated without the necessity of removing the power tong from alignment with the drill string.

The invention herein comprises a closed-head power tong having a power tong body. The tong body has a ring gear positioned within the body, and the ring gear comprises at least one cam surface. The tong body also has a cage plate assembly comprising at least two mating inserts and a jaw aperture formed in at least one of the mating inserts.

The invention may also comprise a power tong body having a ring gear positioned within the body wherein the ring gear has at least one cam surface. A cage plate assembly is removably positioned at least partially within the body and configured to have a gripping aperture therein. The gripping aperture has first dimension and the cage plate assembly is adapted to increase the gripping aperture to a second dimension sufficiently sized to allow passage of an object having a dimension larger than the first dimension.

A method of making up or breaking one or more section of tubular members using the closed head power tong invention is also disclosed herein. The method comprises the steps of (a) removing the cage plate assembly from the power tong body, thereby increasing the diameter of the gripping aperture to allow passage of a tool; and (b) passing the tool through the power tong body a sufficient distance so that the cage plate assembly may be repositioned within the power tong body.

DETAILED DESCRIPTION

Illustrations of construction, design, and methods of operation of the invention are set forth below with specific references to the Figures. However, it is not the intention of the inventor that the scope of his invention be limited to these embodiments.

Figure 1:
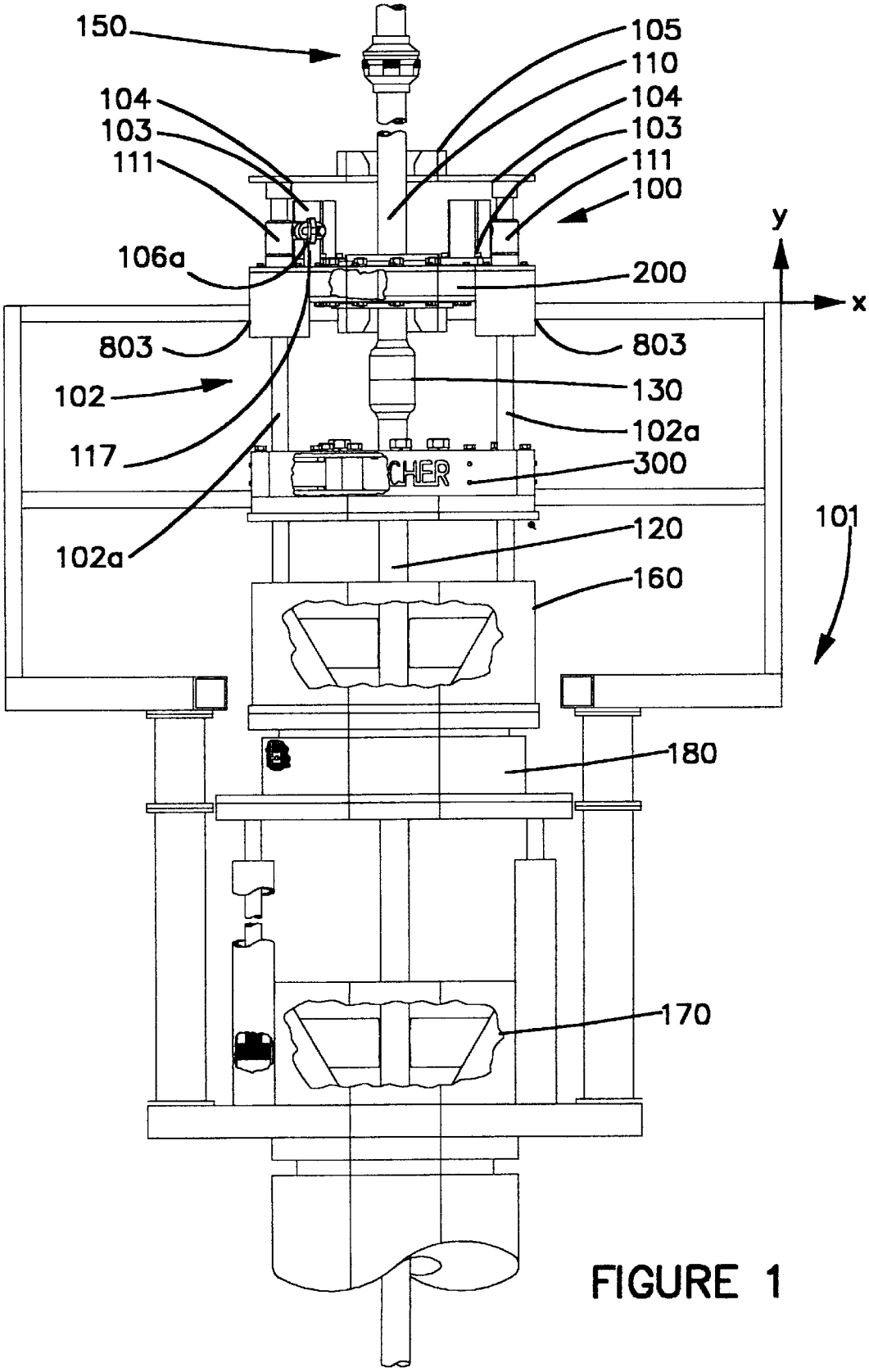
FIG. 1 illustrates a side view of the invention employed in a conventional snubbing unit.

FIG. 1 illustrates the application of the power tong-back-up combination 100 used in connection with a snubbing unit 101 positioned over an existing well. Snubbing unit 101 is equipped with slip assemblies 160, 170 that are used in conjunction to raise and lower tubular members 110, 120 as is known in the art. Snubbing unit 101 may also be equipped with a hydraulic rotary table 180 that rotates equipment positioned thereon.

When lengths of tubular members are joined ("made-up") or disconnected ("broken"), tubular members 110, 120 are passed through the respective gripping apertures 205, 901 (shown in FIG. 2*b*) in power tong 200 and back-up 300. When joint 130 (as seen in FIG. 1) is suitably positioned between power tong 200 and back-up 300, power tong 200 engages and grips first tubular member 110 and a back-up 300 engages and grips second tubular member 120. Power tong 200 rotates first tubular member 110 and back-up 300 grips and holds stationary second tubular member 120. Pipe joint 130 is made-up or broken, depending upon the direction of torque applied to first tubular member 110 by power tong 200.

Figure 2B:
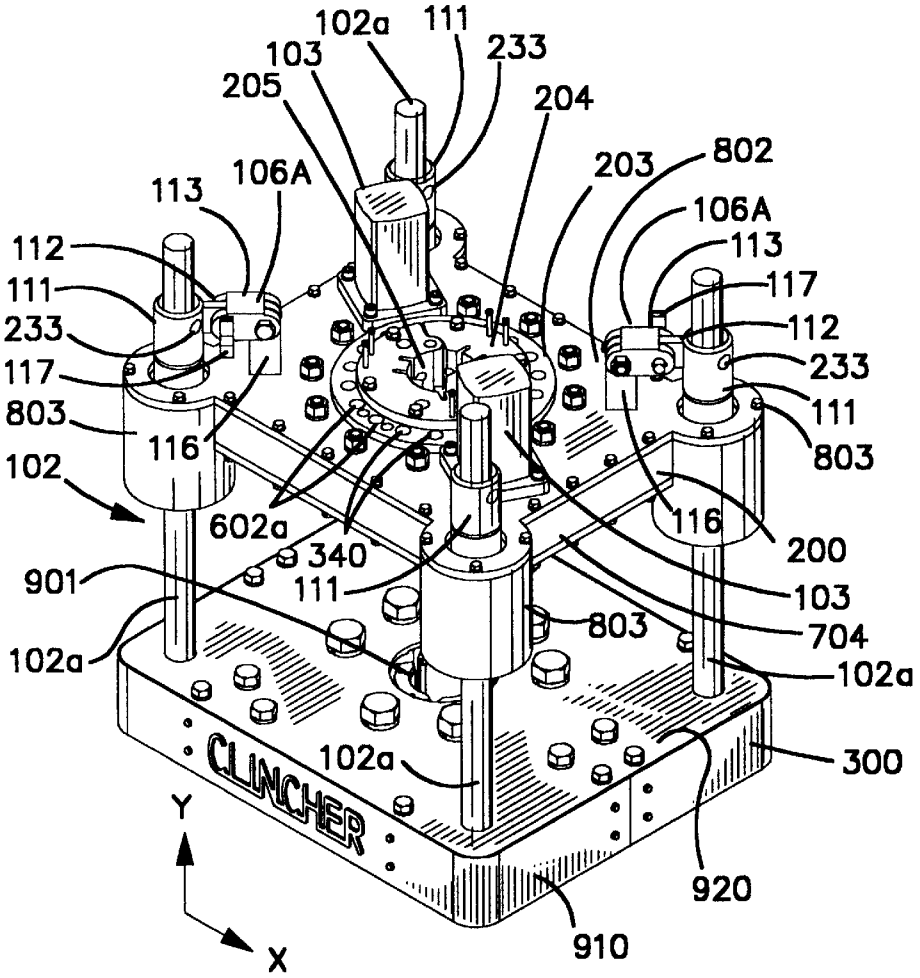
FIG. 2*b* illustrates an upper perspective view of the invention with the top plate removed.
Figure 7:
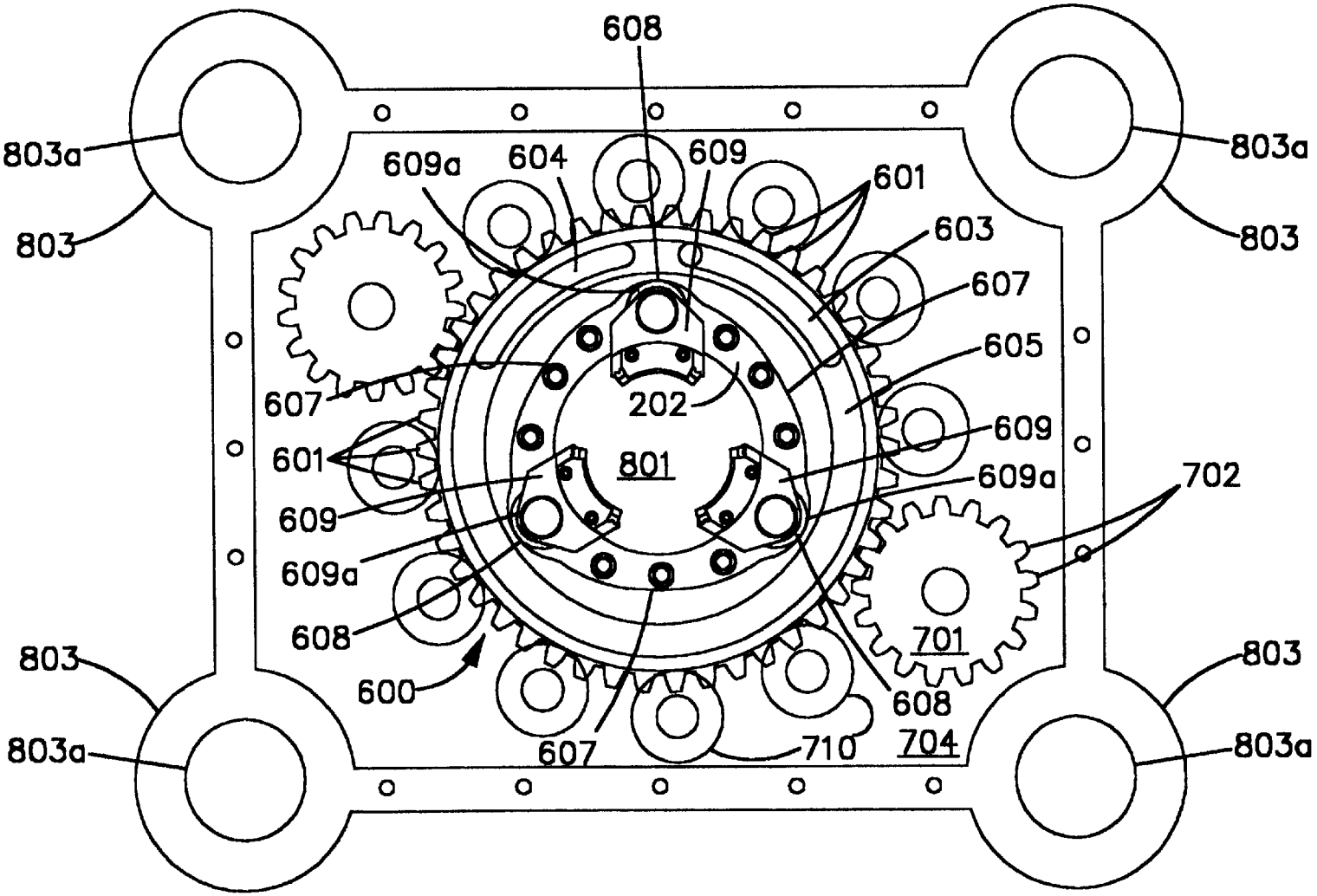
FIG. 7 illustrates an upper view of the power tong with the upper tong plate and upper cage plate removed.
Figure 8:
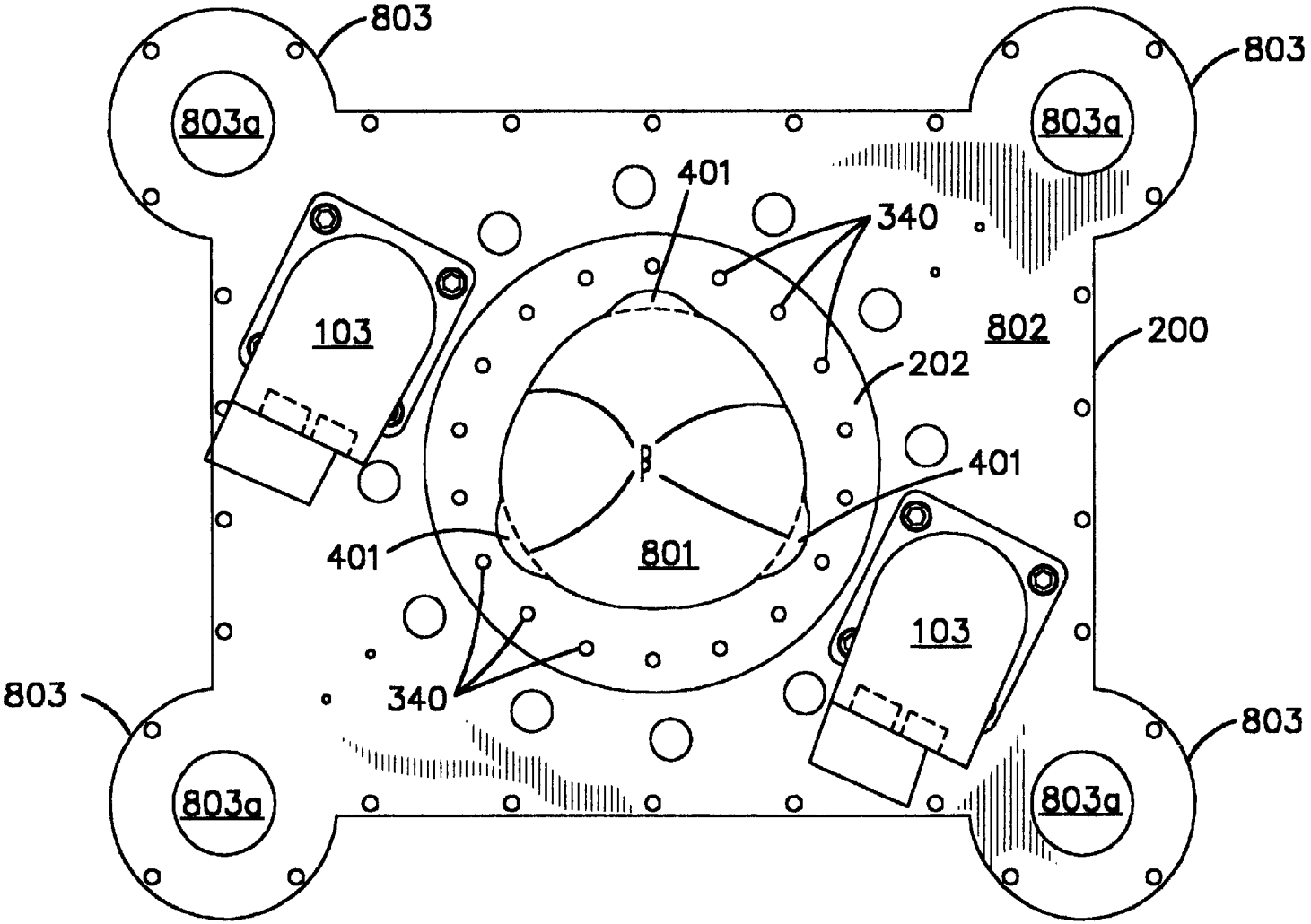
FIG. 8 illustrates an upper view of the power tong with the cage plate assembly removed.

Referring to FIG. 2*b*, closed-head power tongs 200 have a power tong body composed of lower plate 704 and an upper plate 802, both having a center aperture 801 passing therethrough as shown in FIGS. 7 and 8. FIG. 8 illustrates upper plate 802 and motors 103 operatively positioned thereon. A collar 803 having leg apertures 803*a* is positioned at each corner of upper plate 802 to assist in the mounting and operation of power tong 200 on leg assembly 102 as described below and shown in FIG. 2*b*. FIG. 7 illustrates how motors 103 rotate respective gears 701, providing rotational energy to ring gear 600 through interaction of teeth 702 and teeth 601.

Figure 2A:
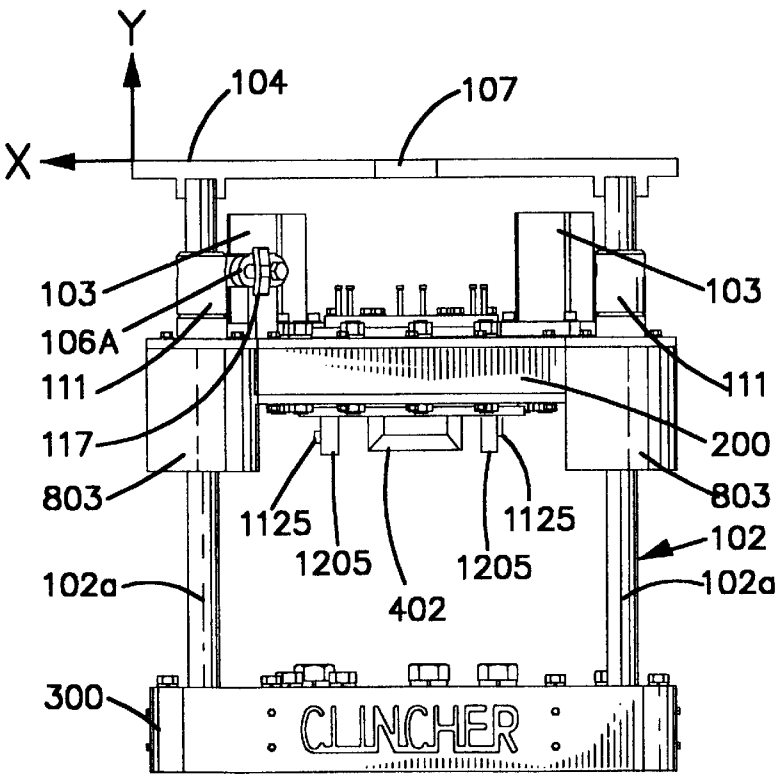
FIG. 2*a* illustrates a side view of the invention.
Figure 4:
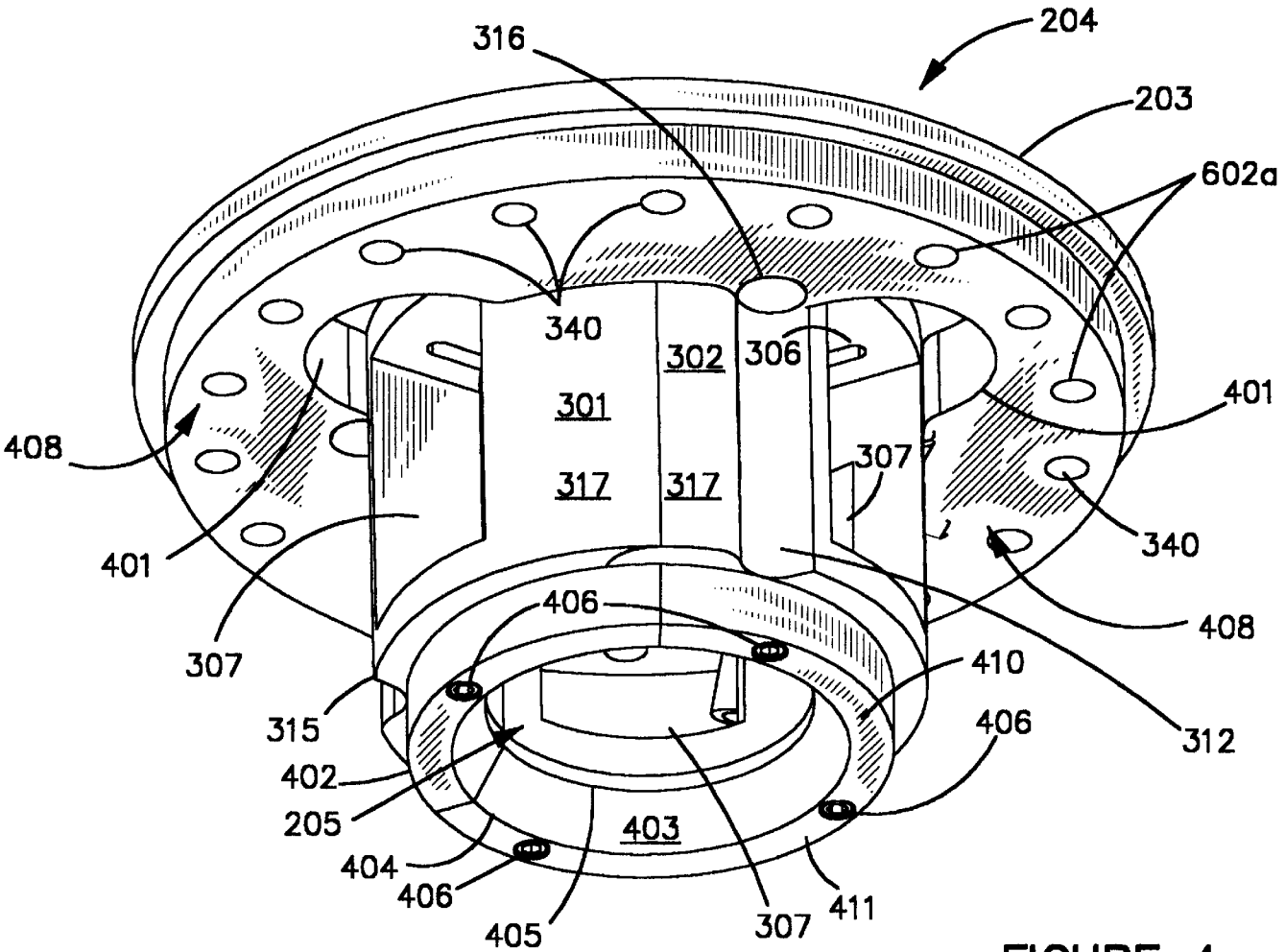
FIG. 4 illustrates a lower perspective view of the mating inserts inserted within the upper cage plate shown without the jaw assemblies positioned in the jaw apertures. The lower cage plate is not shown.

Referring back to FIG. 1, top plate 104 is positioned atop leg assembly 102 and fixes the position of legs 102*a* relative to each other. Top plate 104 has a passageway 107 extending therethrough substantially aligned with gripping apertures 205, 901. Optionally, a tapered pipe inlet 105 is positioned atop top plate 104 and passageway 107 to guide tubular members 110, 120 into closed-head power tong 200 when tubular member 110, 120 are inserted into a well. As shown in FIGS. 2*a* and 4, a pipe inlet 402 is attached to mating inserts 301, 302 to guide tubular member 110, 120 into center aperture 801 in power tong 200 when tubular members 110, 120 are raised from a well.

Figure 9B:
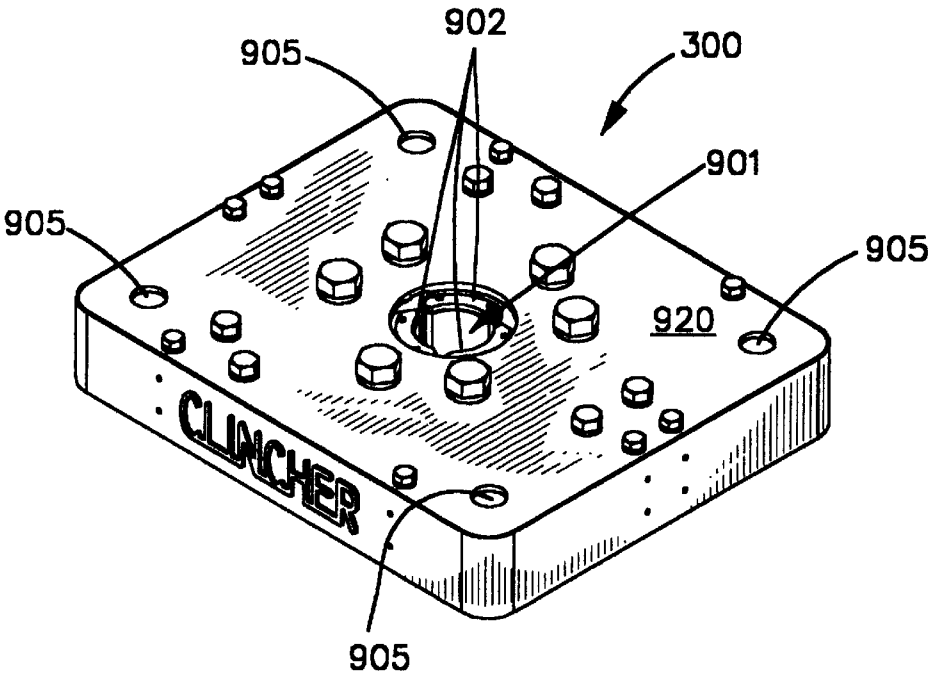
FIGS. 9*a* and 9*b* illustrate embodiments of the back-up used in combination with the present invention.
Figure 9A:
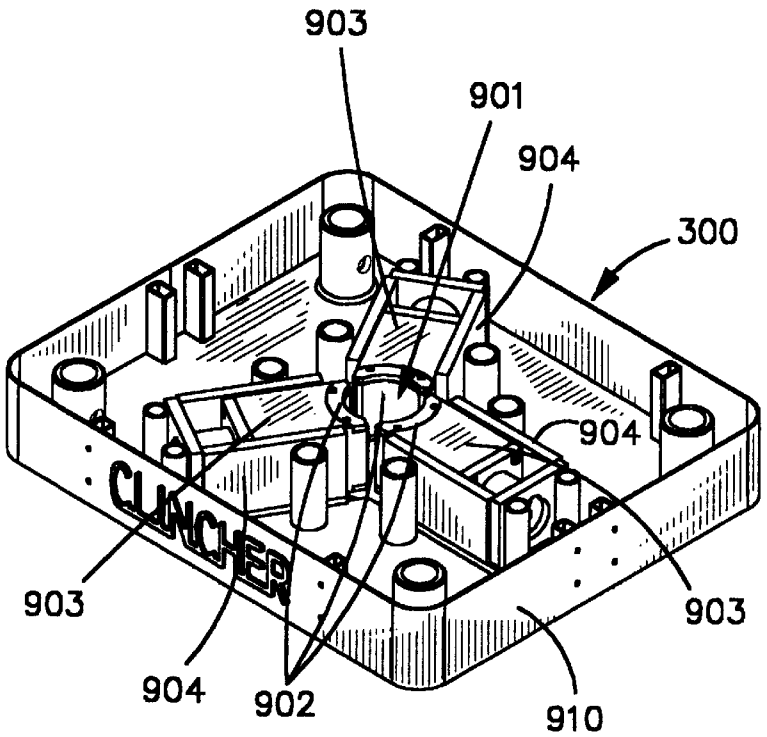

FIG. 9*a* illustrates back-up 300, which comprises a body having a lower section 910, a cover 920 (shown in FIG. 9*b*) and two or more, preferably three, hydraulically powered jaw assemblies 904 positioned therein. As shown in FIG. 9*a*, jaw assemblies 904 have jaw carriers 903 with jaws 902 facing back-up power tong gripping aperture 901 through which tubular members pass. Jaw assemblies 904 are very similar to the jaw assemblies found in U.S. Pat. No. 4,649,777 to Buck, which is incorporated herein by reference. Back-up 300 mounts onto leg assembly 102 via apertures 905 that correspond to each leg 102 substantially as shown in FIG. 2*b*.

Referring to FIG. 1, closed-head power tong 200 and closed-head back-up 300 are positioned on snubbing unit 101 using leg assembly 102 that allows relative vertical displacement of the power tong unit 100. As seen in FIG. 2*b*, power tong 200 locks onto legs 102*a* using spring assembly 106 (shown in FIGS. 2*c* and 2*d*) or any other suitable member known in the art.

Figure 2C:
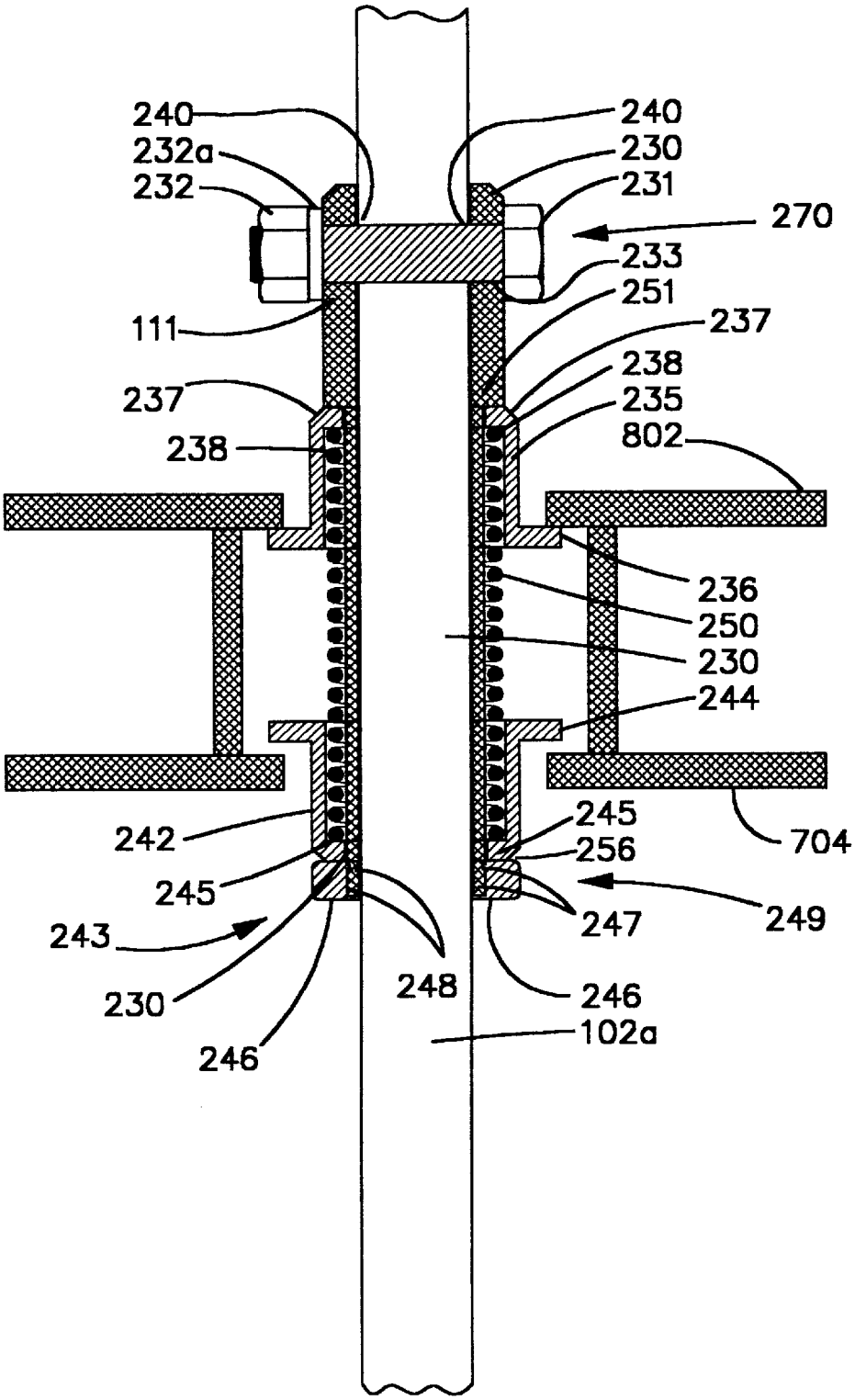
FIG. 2*c* illustrates a cross-sectional view of the spring assembly used to mount the power tong to the leg assembly.
Figure 2D:
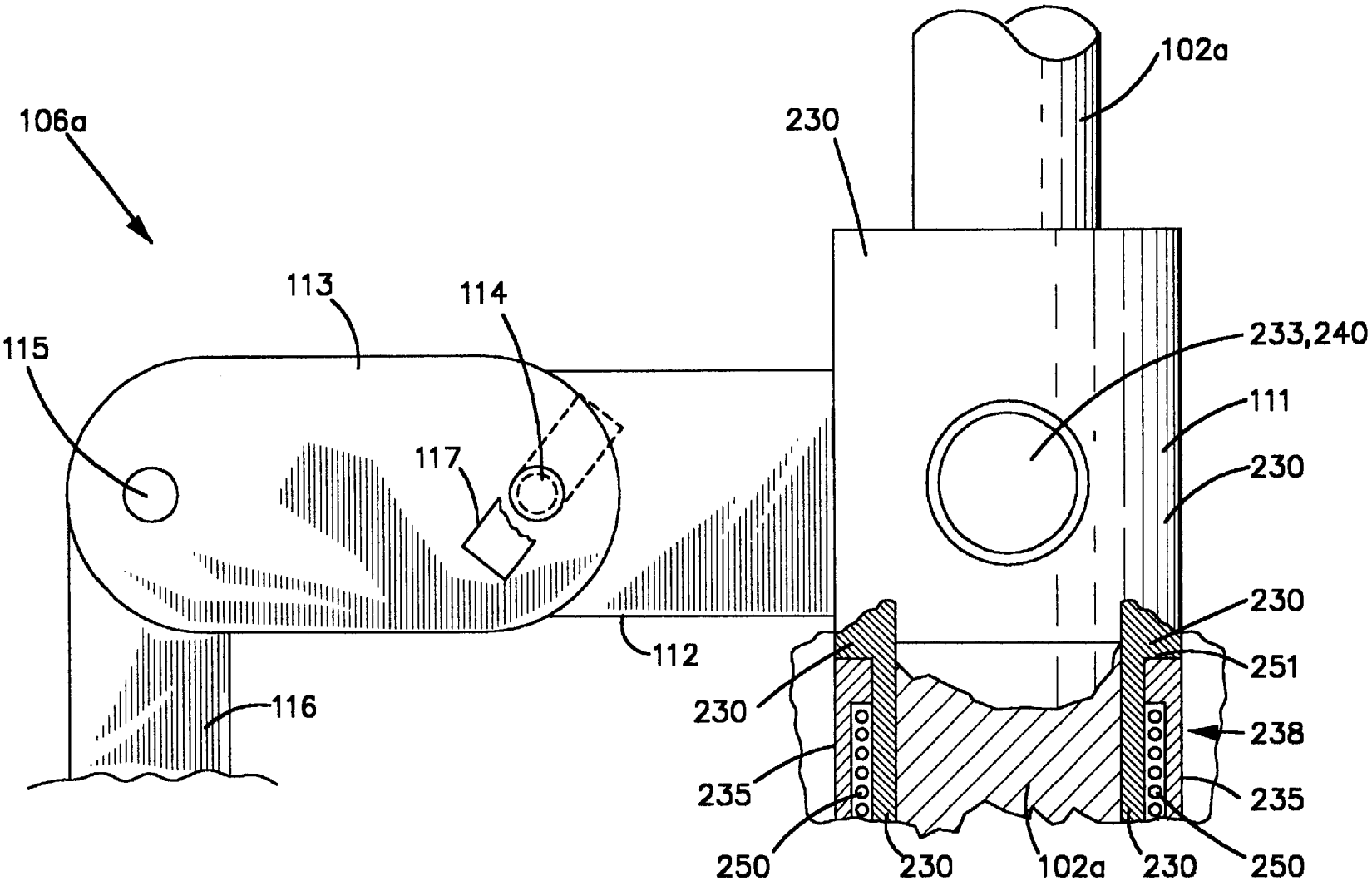
FIG. 2*d* illustrates a side view of the link assembly that mounts the power tong to the leg assembly.

Viewing FIG. 2*c*, each spring assembly 106 comprises a spring tube 230 positionable over one leg 102*a* Spring tube 230 has a first end 270 comprising a collar 111 and a second end 249. Spring tube 230 is fixedly positioned relative to leg 102*a* using a nut 232, washer 232*a*, and bolt 231. Bolt 231 inserts coaxially through bolt passageway 233 in spring tube 230, through holes 240 in leg 102*a*, through the other side of bolt passageway 233, through washer 232*a*, and into nut 232. As also shown in FIG. 2*d*, the lower edge 251 of end 270 (collar 111) provides a shoulder against which first end 238 of spring cap 235 rests.

The second end 249 of spring tube 230 has threads 247 that mate with corresponding threads 248 on spring retainer 246. The upper edge 256 of spring retainer 246 provides a shoulder upon which the first end 243 of spring cap 242 may rest. Spring 250 is positioned between shoulder 237 of spring cap 235 and shoulder 245 of spring cap 242. Upper power tong plate 802 is positioned above and may rest upon spring plate lip 236 so that the weight of power tongs 200 may be supported in part by each of the four spring assemblies 106 and so that spring 250 biases spring cap 235 and upper plate 802 away from end 249.

As power tong 200 grips and rotates first tubular member 110 and back-up 300 grips and holds stationary second tubular member 120, first tubular member 110 is either forced toward or away from second tubular member 120 by action of the corresponding threads at joint 130 on tubular members 110, 120. The construction and design of spring assemblies 106 allow power tong 200 to move vertically to accommodate the vertical motion of the tubular members 110, 120.

When a joint 130 is made-up, first tubular member 110 moves toward second tubular member 120. Accordingly, power tongs 200 move downward. Upper tong plate 802, already in contact with lip 236, forces spring cap 235 to compress spring 250. Note that in an "at rest" position, upper tong plate 802 rests upon lip 236 due to gravity. When the make up is complete and the jaw dies 610 release tubular member 110, the potential energy of spring 250 forces upper plate 802 (and hence power tong 200) back to its normal position.

When a joint 130 is broken, first tubular member 110 moves away from second tubular member 120. Accordingly, power tongs 200 move upward.

Lower tong plate 704 moves upward and abuts lip 244, causing spring cap 242 to compress spring 250. When the joint 130 is broken and jaw dies 610 release tubular member 110, the potential energy in spring 250 forces lower plate 704 (and hence power tong 200) back to its normal position.

Referring to FIG. 2*d*, links 106A movably attach power tong 200 to two of legs 102*a* via collar 111, spring tube 230 and spring assembly 106. Each of these legs 102*a* is configured with one or more holes 240 that allow bolt 231 to insert through holes 233 in collar 111 and through holes 240 in leg 102*a* Bolt 231 fixedly positions collar III relative to leg 102*a*.

Each link 106A comprises a first arm 112 that connects to collar 111 and a second arm 116 that connects to upper tong plate 802 (see FIG. 2*b*). Each arm 112, 116 connects to a third arm 113 which allows arm 112 to move vertically relative to arm 116, allowing power tong 200 to move vertically relative to legs 102*a* as previously discussed. A locking pin 117 (shown in FIG. 2*b*) may be inserted through either pivot hole 114, 115 to prevent vertical displacement of power tong 200 by preventing third arm 113 from pivoting. Links 106A also help prevent the small amount of rotational movement that can occur by power tong 200 relative to legs 102*a* It is generally desirable to engage locking pin 117 when power tong 200 is being transported or handled to prevent unexpected movement between power tong 200 and back-up 300 from injuring workers or damaging equipment.

Figure 3:
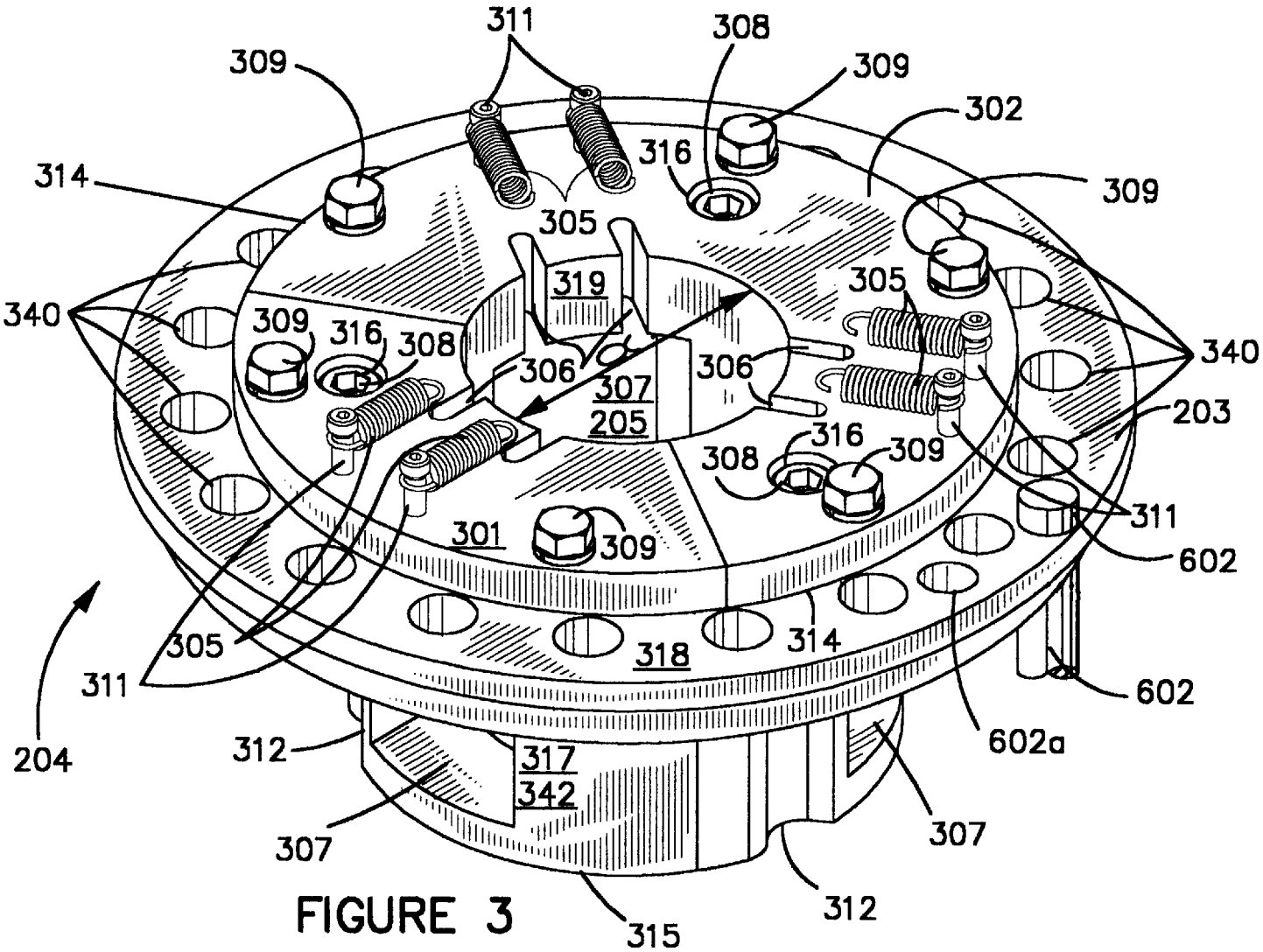
FIG. 3 illustrates an upper perspective view of the mating inserts inserted within the upper cage plate shown without the jaw assemblies positioned in the jaw apertures. The lower cage plate is not shown.
Figure 10:
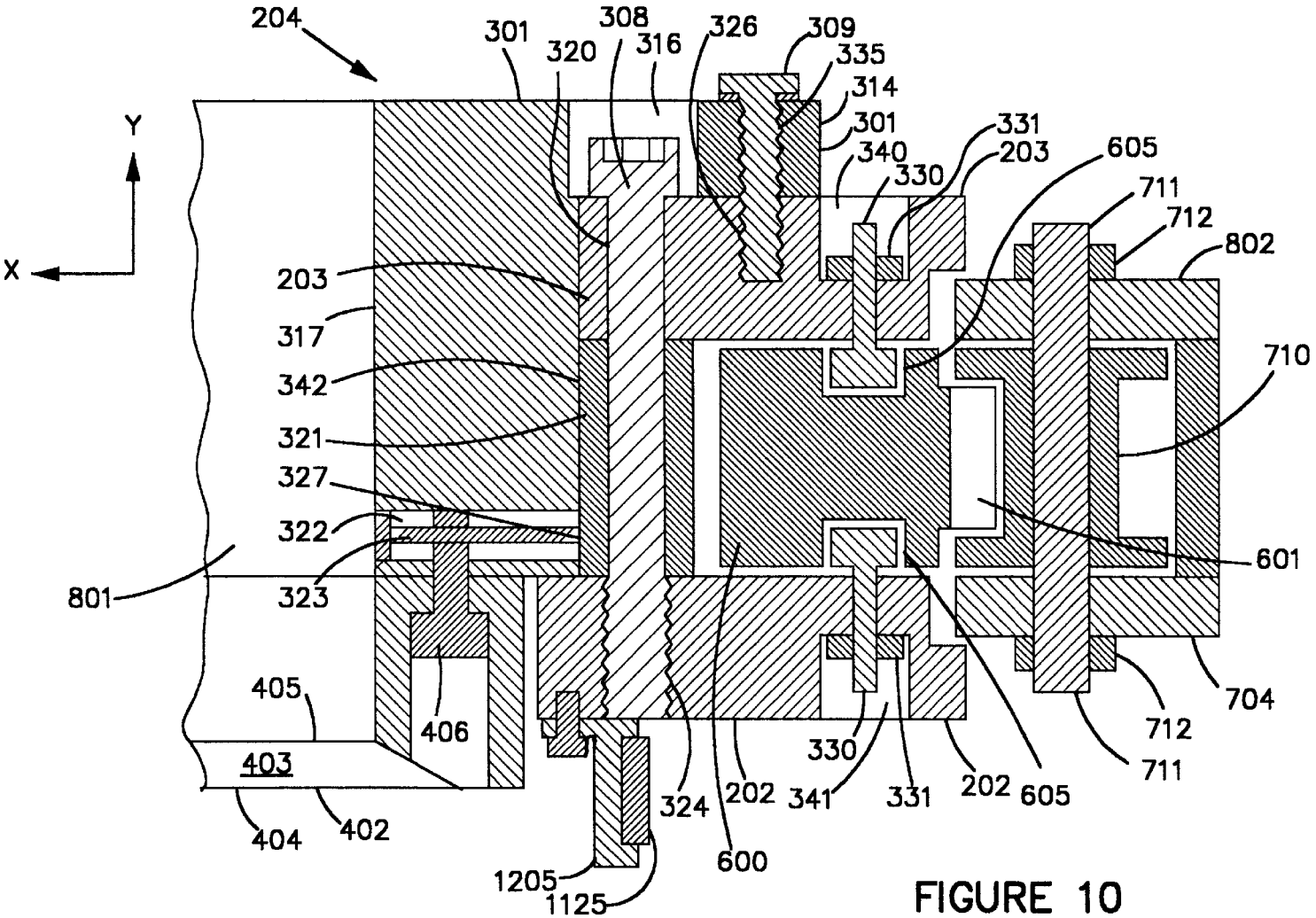
FIG. 10 illustrates a cross-section view of the interrelation of the upper and lower cage plates, the ring gear, and the mating inserts taken along the A—A axis shown in FIG. 3.

Referring to FIG. 10, cage plate assembly 204 generally comprises annular upper and lower cage plates 203, 202. FIG. 3 is a perspective view showing upper cage plate 203 but having lower cage plate 202 removed. While the following description refers primarily to FIG. 10, cross-reference to FIG. 3 will aid in understanding the subject matter discussed. Rollers 710 sit within power tong 200 and mount on shafts 711, which are held in place by nuts 712. Rollers 710 support ring gear 600 by supporting ring gear teeth 601 therewithin. Ring gear 600 is positioned between lower and upper cage plates 202, 203 using cam followers 330 mounted from respective plates 202, 203, with nuts 331 positioned in corresponding apertures 340, 341.

Cage plates 202, 203 are appropriately spaced using spacer tube 321, as seen in FIG. 10, so that ring gear 600 and plates 202, 203 may freely rotate relative to one another. Cage plates 202, 203 are fixedly positioned relative to each other using a bolt 308 inserted through aperture 320 in upper cage plate 203, through spacer tube 321 and into bolt hole 324 in lower cage plate 202.

Figure 6A:
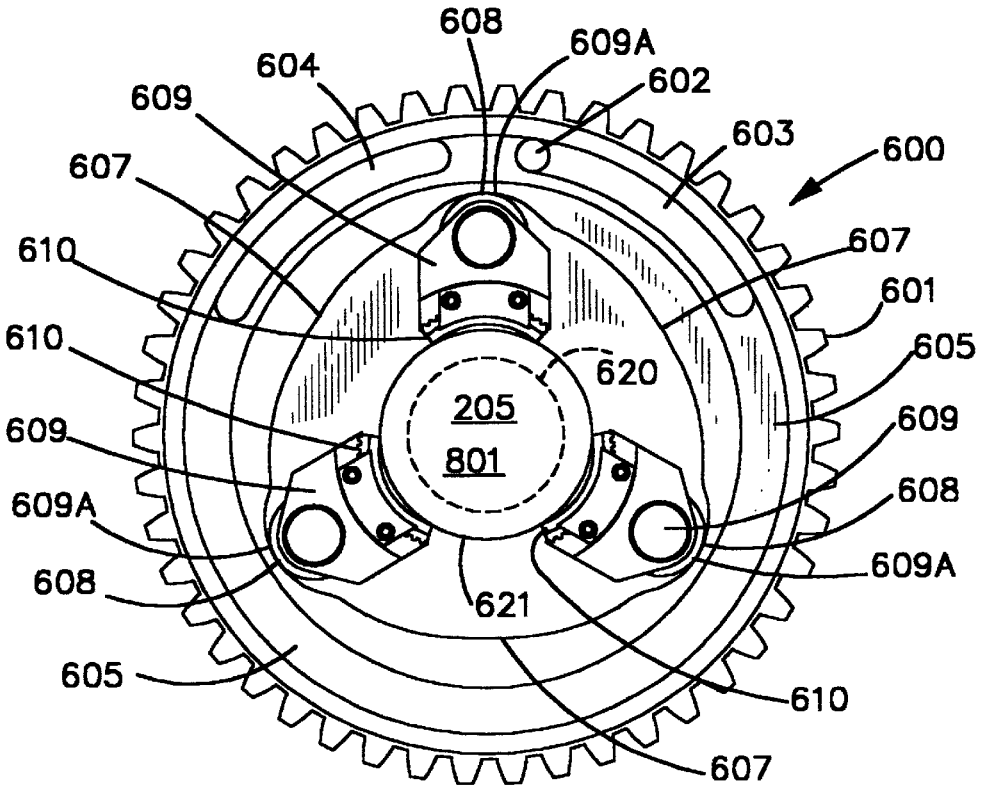
FIGS. 6*a* and 6*b* illustrate embodiments of the ring gear with three camming surfaces engaging the jaw assemblies.
Figure 6B:
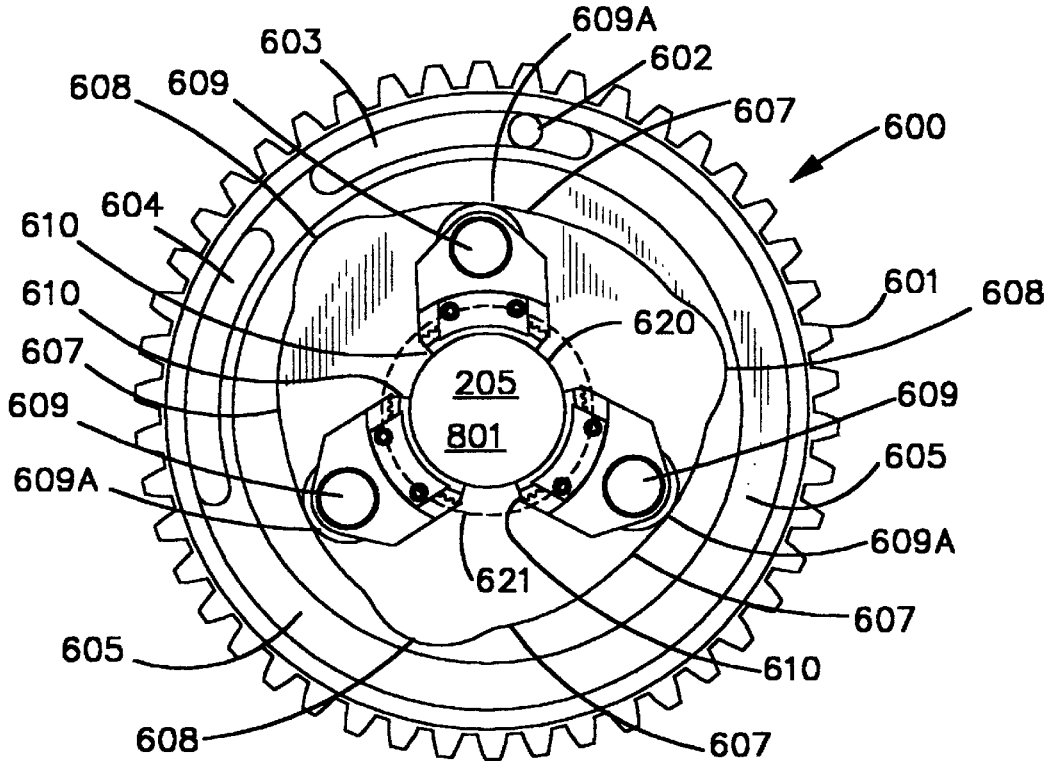

Viewing FIGS. 6*a* and 6*b*, ring gear 600 also has one or more cam surfaces 607 that face jaw assemblies 609. The rotation of ring gear 600 about the jaw assemblies 609 causes engagement and retraction of the jaw assemblies 609 (and jaw dies 610 thereon) with the tubular member as rollers 609A roll upon cam surfaces 607. Causing jaws 610 to ride upon cam surfaces 607 requires relative rotation between ring gear 600 and cage plates 202, 203 attached to mating inserts 301, 302, which in turn carry jaw assemblies 609. For example, see U.S. Pat. No. 4,404,876 to Eckel or U.S. Pat. No. 5,291,808 to Buck, which are incorporated by reference herein. A preferred jaw assembly 609 used with the present invention is a low friction jaw assembly such as that disclosed in U.S. Pat. No. 5,819,605 to Bangert, et al.

To allow initial relative rotation between ring gear 600 and cage plates 202, 203, a brake band 1125 (see FIG. 12) typically applies a limited frictional force to cage plate 202 and allows ring gear 600 to rotate relative to the cage plates 202, 203 until jaws 610 engage the tubular member. Cage plates 202, 203 and ring gear 600 then rotate in unison, thereby applying torque to the tubular member.

Jaw assemblies 609 are shown retracted in FIG. 6*a* and engaged in FIG. 6*b* with mating inserts 301, 302 not shown. The lines denoted as 620, 621 show the minimum and maximum retraction and extension points of jaw dies 610.

Figure 12:
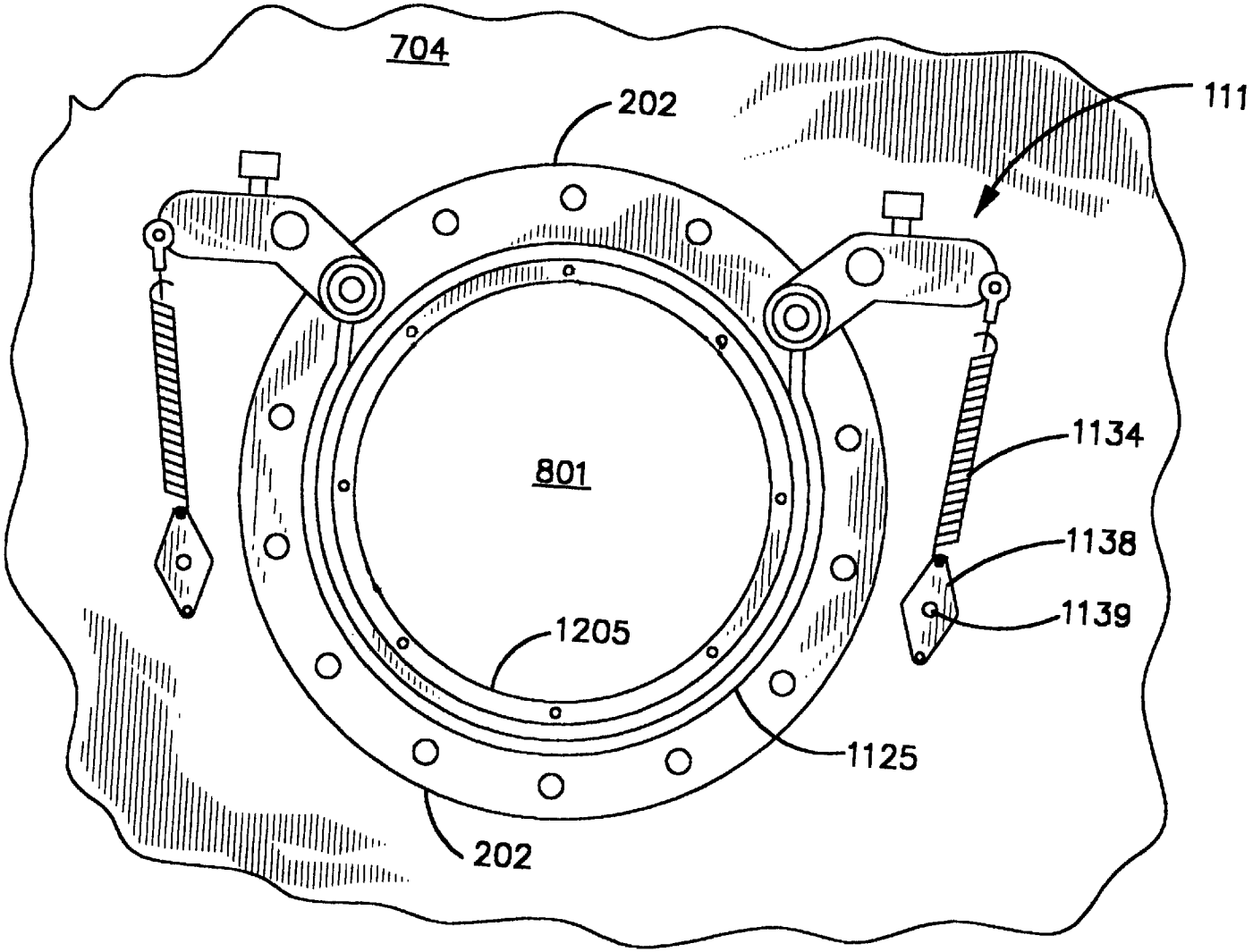
FIG. 12 illustrates a partial bottom view of the power tong showing the brake band's engagement with the brake ring.

Viewing FIG. 12, to initially hold cages plates 202, 203 stationary while ring gear 600 rotates sufficiently to close jaw dies 610, a brake band 1125 acts upon lower cage plate 202. In the embodiment shown, brake band 1125 actually contacts brake ring 1205, which acts as an extension of cage plate 202 as best seen in FIG. 10. Brake band 1125 applies an initial frictional force to lower cage plate 202 through brake ring 1205, holding cage plates 202, 203 stationary and allowing ring gear 600 to move relative to cage plates 202, 203. Generally, it is desirable to make brake band 1125 adjustable such that it may be tightened or loosened in order to vary the amount of frictional force applied to cage plate 202.

After relative rotation begins, jaw assemblies 609 mount cam surfaces 607 via jaw rollers 609A and close on the tubular. After closing on the tubular, ring gear 600 continues to transfer torque to jaw assemblies 609 and therefore to cage plates 202, 203 eventually causing cage plate 202 to overcome the resisting frictional force of brake band 1125. Because cam surfaces 607 translate torque into radial force, a higher torque needed to overcome the resistance of brake band 1125 results in a higher initial radial force being placed on the tubular prior to cage plates 202, 203 beginning to rotate. Therefore, the frictional resistance of the brake band 1125 is adjusted to regulate the initial radial load or initial "bite" with which jaw assemblies 609 grip the tubular.

The embodiment of brake band 1125 as shown in FIG. 12 is similar to the brake band disclosed in U.S. patent application Ser. No. 08/897,185, which is incorporated herein by reference. Brake band 1125 is biased against brake ring 1205 using a spring 1134. Spring 1134 pivotally connects to brake arm 1111. Spring 1134 also pivotally connects to power tong lower plate 704 using spring retainer 1138 and pivot pin 1139. Brake band 1125 constantly maintains frictional resistance between brake band 1125 and brake ring 1205 during the entire operating sequence of power tong 200.

Figure 5A:
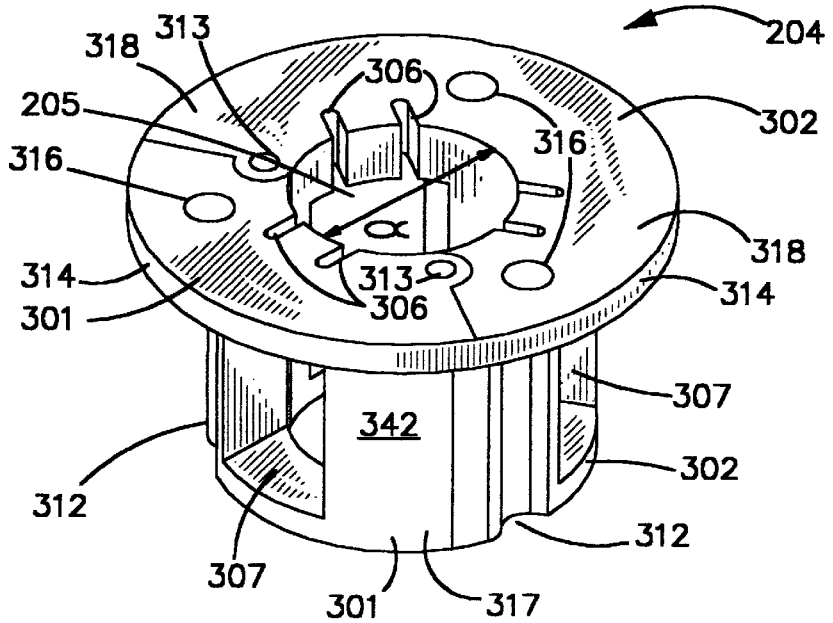
FIGS. 5*a* and 5*b* illustrate an embodiment of the mating inserts shown attached (FIG. 5*a*) and detached (FIG. 5*b*).
Figure 5B:
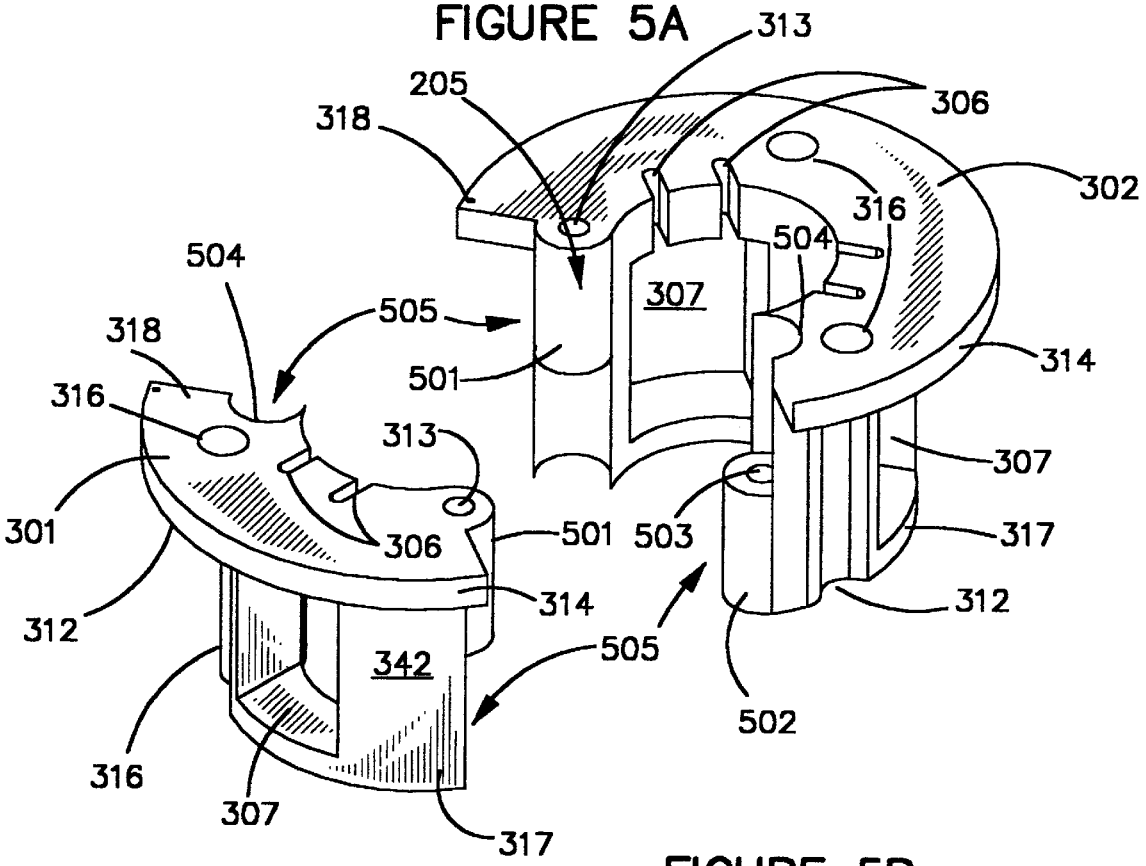
Figure 5C:
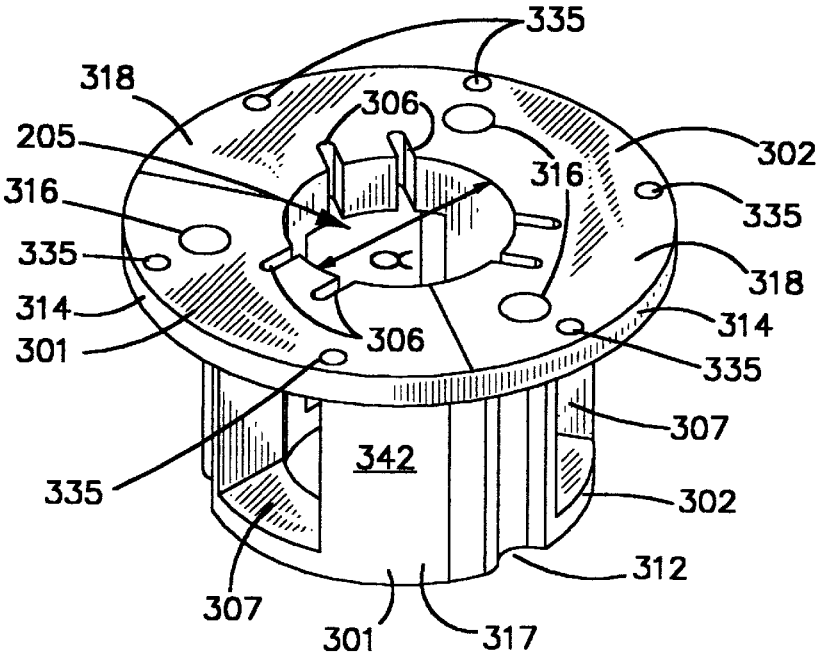
FIGS. 5*c* and 5*d* illustrate another embodiment of the mating inserts shown attached (FIG. 5*c*) and detached (FIG. 5*d*).
Figure 5D:
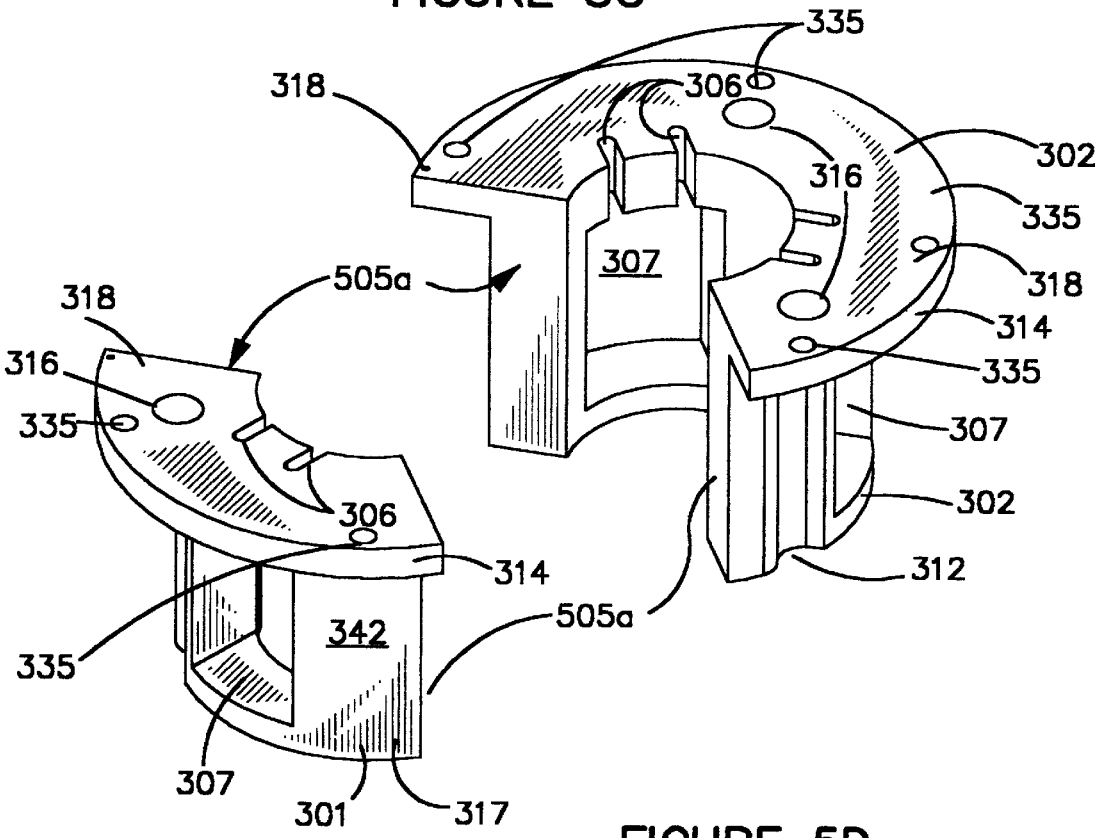
Figure 11:
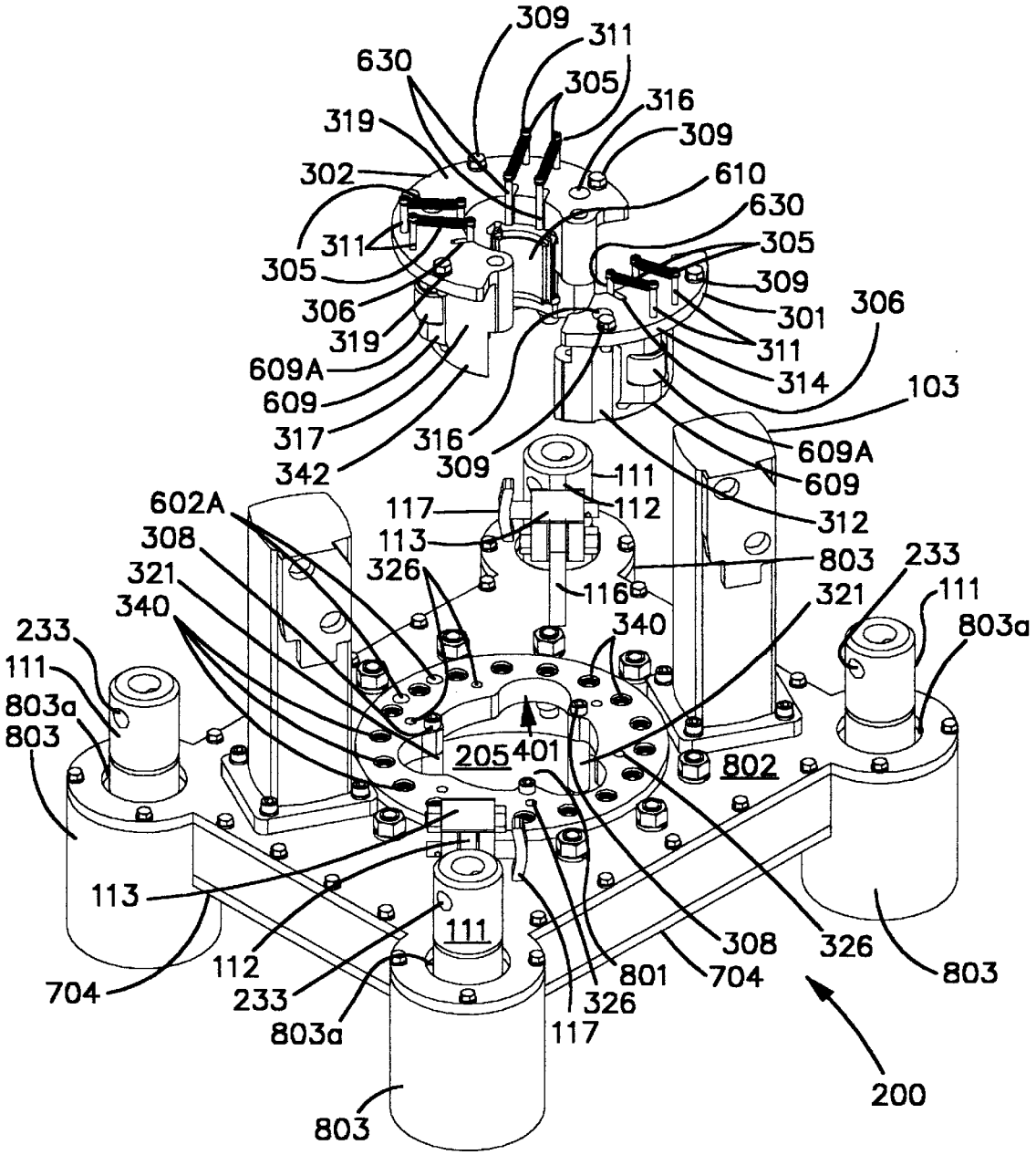
FIG. 11 illustrates an exploded view of the invention shown with the mating inserts removed from within the power tong.

As best seen in FIG. 11, positionable within the annulus of cage plate 203 (hence within center aperture 801) are at least two mating inserts 301, 302, preferably only two as shown in FIG. 5*d*. Viewing FIG. 5*d*, mating inserts 301, 302 also have an upper lip 314 that rests upon the upper surface 318 of plate 203 (as shown in FIGS. 3 and 10). Mating insert sidewalls 317 extend downward from lip 314 and into center aperture 801 as seen in FIG. 11.

As shown in FIG. 5*d*, one or more apertures 316 are positioned within the upper surface 318 of inserts 301, 302 and extend through lip 314. Apertures 316 allow upper cage plate 203 and lower cage plate 202 to be fixedly positioned relative to each other via bolts 308 and spacer tube 321 as seen in FIG. 10.

Referring to FIG. 10, one or more bolts 308, having a threaded lower end 324 extend through inserts 301, 302 (via bore 320 in upper cage plate 203) through spacer tube 321 and into bolt bore 324 in lower cage plate 202. Bolt 308 inserts completely within aperture 316 so that inserts 301, 302 may be removed from center aperture 801 (as seen in FIG. 11) without removing bolt 308. Because aperture 316 is configured only slightly larger than the head of bolt 308, the head of bolt 308 is configured with an internal engagement surface (shown in FIG. 10) to allow a tool, such as an Allen wrench, to engage and remove or install bolt 308. Alternatively, aperture 316 may be sized sufficiently so that a conventional wrench may engage the perimeter of the head of bolt 308.

One or more connecting members 309, such as bolts and associated washers (shown in FIGS. 3 and 10), connect inserts 301, 302 to upper cage plate 203 via bolt hole 326 so that upper and lower cage plates 203, 202 and inserts 301, 302 may rotate concurrently.

FIG. 11 illustrates a unit having three jaw assemblies 609. Viewing FIGS. 4, 5*a* and 5*b*, sidewall(s) 317 are configured to have jaw apertures 307 extending therethrough to allow jaw assemblies 609 (also shown in FIGS. 6*a* and 6*b*) to be positioned therein with the jaw dies 610 facing gripping aperture 205. Viewing FIG. 11, each jaw 610 is biased in an retracted position using jaw springs 305 connected between pins 311 (best seen in FIG. 3) and the upper stems 630 on jaw assemblies 609. Stems 630 slide within notches 306 formed in upper wall 319. Notches 306 aid in biasing jaw assemblies 609 in a retracted position.

As shown in FIG. 4, mating inserts 301, 302 have recesses 312 formed in sidewalls 317. Spacer tubes 321 (not shown in FIG. 4, see FIG. 10) fit into recesses 312 so that cage plates 202, 203 may be operatively connected by bolt 308. Each jaw aperture 307 has a corresponding recess 401 formed in the lower portion 408 of cage plate 203 to allow jaw assembly 609 to be lifted from within cage plate 203 as seen in FIG. 11.

Pipe inlet 402 is attached to the lower end 315 of mating inserts 301, 302 and may itself comprise mating sections 410, 411 that form inlet 402 when mating inserts 301, 302 are mated. Sections 410, 411 attach to lower end 315 using any suitable means, preferably using one or more bolts 406. Inlet 402 has a tapered sidewall 403 that converges from lower end 404 to upper end 405 to assist tubular members entering gripping aperture 205. The converging sidewall 403 is also shown in FIG. 10.

Viewing FIG. 10, insert sidewalls 317 have a pin hole 322 configured therein having an opening 327 in the outer surface 342 of sidewall 317 facing spacer tube 321. Bolt 406 has a hole therein that allows pin 323 to slide within hole 322 and through the hole in bolt 406. When inserts 301, 302 are positioned within center aperture 801, spacer tube 321 prevents pin 323 from disengaging bolt 406, preventing inlet 402 from detaching from inserts 301, 302.

FIGS. 5*a* and 5*b* illustrate one embodiment of mating inserts 301, 302 used in cage plate assembly 204. FIG. 5*a* illustrates the mating inserts 301, 302 removed from cage plate assembly 204 and removed from within center aperture 801 in power tong 802. Viewing FIG. 5*b*, insert 302 comprises at least one male mating member 501, more preferably male mating members 501, 502 positioned at each mating side 505 of insert 301. Male mating members 501, 502 engage and abut female mating members 504 formed in the corresponding mating inserts 301, 302 as recesses. When mated, apertures 313 in inserts 301, 302 are substantially aligned with lower apertures 503 positioned in the lower male mating members 502 so that a pin 304 (see FIG. 3) or other suitable member, may be positioned therein to position mating inserts 301, 302 relative to each other.

FIGS. 5*c* and 5*d* illustrate an alternate embodiment of the mating inserts 301, 302. FIG. 5*c* illustrates mating inserts 301, 302 removed from cage plate assembly 204 and removed from within center aperture 801 in power tong 802. As shown, inserts 301, 302 are simply sectioned and have only mating sides 505*a* with no mating members to hold inserts 301, 302 together.

FIG. 5*c* illustrates gripping aperture 205 having its smallest diameter, referred to as a first dimension and marked as first dimension $\alpha$ in FIG. 5*c*. FIGS. 5*d* and 11 illustrate how sections 301, 302 can be removed from within center aperture 801 and detached to allow the passage of a downhole tool 150, having a dimension larger than first dimension $\alpha$ but smaller than the dimension $\beta$ of center aperture 801 as best seen in FIG. 8. As used herein "dimension," when used to refer to the size of an aperture shall mean the distance necessary for an object, such as downhole tool 150, to pass therethrough. When the downhole tool 150 has passed through power tong 200, sections 301, 302 reattach to each other using pin 304 and repositioned within center aperture 801.

As shown in FIG. 7, a ring gear 600 is positioned within power tong body on rollers 710 (see also FIG. 10). Ring gear 600 comprises outer gear teeth 601 that mate with the gear teeth 702 on gear 701, rotated by motors 103 as shown in FIG. 7. Viewing FIG. 6*a*, ring gear 600 further comprises cam follower slot 605 so that followers 330 (see FIG. 10) may be positioned therein. Slot 605 has one or more slits 603, 604 configured therein which receive a pin 602, commonly known as a reversing pin in the art. FIG. 3 illustrates how reversing pin 602 engages one of two apertures 602*a* formed in cage plate 203.

When jaw assemblies 610 retract, jaw rollers 609A roll along cam surface 607 until rollers 609A reach a recess 608. At this point, pin 602, which is positioned in either slot 603, 604, stops the relative rotation between ring gear 600 and cage plates 202, 203 so that jaw rollers 609A do not roll further upon an adjacent cam surface 607 and re-grip the tubular. Pin 602 limits the travel of rollers 609A along cam surface 607 when tubular is gripped, thereby preventing rollers from traveling to an adjacent neutral surface and preventing jaws 610 from crushing the tubular.

While not shown in the Figures, one modification of the present invention could include the positioning of a conventional load cell thereon. The load cell could be used to measure the torque imparted to power tong 200 relative to back-up 300 during operation of the system. For example, a load cell is first affixed to power tong 200. A vertical pressure plate is then affixed to back-up 300 such that the pressure plate are adjacent to the load cell. When power tong 200 applies torque to a tubular, there is a tendency for power tong 200 to rotate relative to back-up 300. This tendency to rotate causes the vertical pressure plate to load the load cell. In this manner, the torque imparted to the tubular by power tong 200 can be measured. Those skilled in the art will recognize that this is but one way to measure torque. Load cells could be mounted in numerous ways upon power tong 200 to achieve the same effect. Moreover, the measurement techniques are not limited to load cells, hydraulic or otherwise. Many alternate devices for measuring loads could be employed to determine the torque imparted on the tubular.

As used herein, "vertical" shall mean substantially along the y-axis or plane created by the y-axis shown in the Figures, while "horizontal" shall mean substantially along the x-axis or plane created by the x-axis shown in the Figures where the axes are shown.

Finally, while many parts of the present invention have been described in terms of specific embodiments, it is anticipated that still further alterations and modifications thereof will no doubt become apparent to those skilled in the art. It is therefore intended that the following claims be interpreted as covering all such alterations and modifications as fall within the true spirit and scope of the invention.

I claim:

1. A closed-head power tong comprising:

a power tong body;

a ring gear positioned within said body and comprising at least one cam surface;

a cage plate assembly comprising:

at least two mating inserts removably positioned within at least a portion of said power tong body; and a jaw aperture formed in at least one of said mating inserts.

2. A closed-head power tong according to claim 1 wherein said cage plate assembly further comprises a cage plate ring.

3. A closed-head power tong according to claim 1 wherein said cage plate assembly further comprises at least one jaw assembly insertable into said jaw aperture.

4. A closed-head power tong according to claim 1 wherein said mating inserts are independently formed.

5. A closed-head power tong according to claim 1 wherein said ring gear has a number of cam surfaces equal to the number of said jaw apertures.

6. A closed-head power tong according to claim 1 further comprising at least one jaw spring connected between said cage plate assembly and said jaw assembly.

7. A closed-head power tong according to claim 6 wherein said jaw spring biases said jaw assembly in a retracted position.

8. A closed-head power tong according to claim 1 wherein said mating inserts are releasably connected.

9. A closed-head power tong according to claim 1 wherein said mating inserts comprise at least one mating section, each said mating section engageable with a corresponding mating section on a corresponding mating insert.

10. A closed-head power tong according to claim 1 wherein one of said mating inserts comprises at least a male mating section and another corresponding mating insert comprises at least a female mating section corresponding to said male mating section.

11. A closed-head power tong according to claim 1 wherein said mating inserts are movably connected.

12. A closed-head power tong according to claim 1 further comprising a tapered pipe guide positioned above said power tong.

13. A closed-head power tong according to claim 1 further comprising a tapered pipe guide attached to a lower end of said mating inserts.

14. A closed-head power tong according to claim 1 further comprising a back-up.

15. A closed-head power tong according to claim 14, wherein said back-up includes three hydraulically powered jaw assemblies, wherein said jaws move in an axial direction to grip a tubular member.

16. A closed-head power tong according to claim 1, wherein said ring gear is a solid circular ring.

17. A closed-head power tong according to claim 1, wherein said ring gear has three cam surfaces formed thereon.

18. A closed-head power tong according to claim 17, wherein said ring gear further comprises recess with cam surfaces position on each side of said recess.

19. A closed-head power tong according to claim, 17, wherein said ring gear further comprises three recesses with cam surfaces position on each side of each of said three recesses.

20. A closed-head power tong according to claim 1, wherein said mating inserts have planar mating sides.

21. A closed-head power tong comprising:

a. power tong body;

b. a ring gear positioned within said body and comprising at least one cam surface; and, c. a cage plate assembly removably positioned at least partially within said body and configured to have a gripping aperture therein having a first dimension, wherein said cage plate assembly is adapted to increase said gripping aperture to a dimension sufficiently sized to allow passage of an object having a corresponding dimension larger than said first dimension through said gripping aperture.

22. A closed-head power tong comprising:

a power tong body;

a ring gear positioned within said body and further including a cam surface;

a cage plate assembly comprising:

two separately formed mating inserts removably positioned within said ring gear; and a jaw aperture formed in said mating inserts such that a jaw positioned in said aperture may engage said cam surface on said ring gear;

wherein removal of said mating inserts from within said ring gear allows said mating inserts to be separated and thereby forms a larger diameter passage through said power tong body.

23. A closed-head power tong according to claim 22, wherein a motor positioned on said power tong supplies torque to said ring gear.

* * * * *